US006690147B2

(12) United States Patent
Bonto

(10) Patent No.: US 6,690,147 B2
(45) Date of Patent: Feb. 10, 2004

(54) LDO VOLTAGE REGULATOR HAVING EFFICIENT CURRENT FREQUENCY COMPENSATION

(75) Inventor: Olivier Bonto, Cagnes sur mer (FR)

(73) Assignee: Texas Instruments Incorporated, Dallas, TX (US)

( * ) Notice: Subject to any disclaimer, the term of this patent is extended or adjusted under 35 U.S.C. 154(b) by 5 days.

(21) Appl. No.: 10/153,938

(22) Filed: May 23, 2002

(65) Prior Publication Data

US 2003/0218450 A1 Nov. 27, 2003

(51) Int. Cl.[7] ..... G05F 1/575
(52) U.S. Cl. ..... 323/280; 323/273
(58) Field of Search ..... 323/273, 280

(56) References Cited

U.S. PATENT DOCUMENTS

| | | | | |
|---|---|---|---|---|
| 4,823,070 A | | 4/1989 | Nelson | |
| 5,648,718 A | * | 7/1997 | Edwards | 323/280 |
| 5,705,919 A | | 1/1998 | Wilcox | |
| 5,776,173 A | | 7/1998 | Madsen, Jr. et al. | |
| 5,850,139 A | * | 12/1998 | Edwards | 323/280 |
| 5,852,359 A | * | 12/1998 | Callahan et al. | 323/280 |
| 5,945,818 A | * | 8/1999 | Edwards | 323/273 |
| 6,175,223 B1 | | 1/2001 | Martinez et al. | |
| 6,188,211 B1 | * | 2/2001 | Rincon-Mora et al. | 323/273 |
| 6,205,194 B1 | | 3/2001 | Lafon | |
| 6,246,221 B1 | * | 6/2001 | Xi | 323/280 |
| 6,300,749 B1 | | 10/2001 | Castelli et al. | |
| 6,333,623 B1 | | 12/2001 | Heisley et al. | |
| 6,420,857 B2 | * | 7/2002 | Fukui | 323/280 |

* cited by examiner

*Primary Examiner*—Jeffrey Sterrett
(74) *Attorney, Agent, or Firm*—April M. Mosby; Wade James Brady, III; Frederick J. Telecky, Jr.

(57) ABSTRACT

A low drop out linear voltage regulator (200) overcomes the dynamic quiescent current limitation by creating an internal zero that moves in the same direction and has the same amplitude as that of the output pole without sensing a portion of the load current. The low drop out linear voltage regulator (200) having frequency compensation in accordance with the present invention includes an error amplifier (202), a NMOS pass transistor (204), a variable compensation network ($C_i$, 206), and a stabilization circuit (208, 210, $I_3$, $I_4$). The error amplifier (202) includes a power supply input connected to a first power supply, a non-inverting input coupled to a reference voltage, a inverting input and an output terminal. The NMOS pass transistor (204) includes a source connected to an output terminal of the voltage regulator, a drain coupled to the second power supply, and a gate coupled to the output terminal of the error amplifier. The variable compensation network ($C_i$, 206) connects to the error amplifier. More particularly, the variable compensation network may include an RC circuit comprising a resistive transistor (206) and a capacitance ($C_i$) coupled in series. The stabilization circuit (208, 210, $I_3$, $I_4$) couples between the NMOS pass transistor (204) and the resistive transistor (206), such that the ratio of the impedance of the NMOS pass transistor (204) to the impedance of the resistive transistor (206) is constant.

6 Claims, 3 Drawing Sheets

LDO VOLTAGE REGULATOR HAVING EFFICIENT CURRENT FREQUENCY COMPENSATION

FIELD OF THE INVENTION

The present invention relates to low drop out linear voltage regulators, and, more particularly, to a low drop out linear voltage regulator having efficient frequency compensation using a voltage follower compensation technique.

BACKGROUND OF THE INVENTION

Power management control systems including voltage regulators are incorporated within portable electronic devices to generate a stable output voltage from a varying input voltage supply. A few of these portable electronic devices include laptop computers, hand-held electronic devices, and cellular phones. The purpose of the voltage regulator is to regulate the external power supplied to the internal circuitry such that the current usage or quiescent power is efficient. The efficiency of battery powered supply systems is directly related to the amount of power dissipated in the voltage regulator. More efficient current usage decreases the size of the required voltage supply. This decrease in voltage supply or battery size enables a designer of the aforementioned portable electronic devices to reduce the weight and size of the portable unit.

A particular type of voltage regulator, the low drop out (LDO) linear voltage regulator is used to reduce power consumption by providing the lowest voltage drop across the linear regulator. The lowest voltage drop the regulator can tolerate before loss of regulation occurs is called the "drop-out" voltage. As shown in FIG. 1, a linear voltage regulator 10 conventionally includes an amplifier 14 which compares the output of a voltage reference 12 to a sample of an output voltage supplied by feedback elements 24. The output of the amplifier 14 is coupled to a control terminal 16 of a pass element 18 which serves to "pass" current from the unregulated input terminal 20 of the voltage regulator 10, to the regulated output terminal 22 of the voltage regulator 10. The feedback control loop 26 formed by the amplifier 14, pass element 18 and feedback elements 24 acts to force the control terminal 16 of the pass element 18 to a dynamic value that maintains a regulated voltage at the output terminal 22 of the voltage regulator 10.

More specifically, a conventional LDO linear voltage regulator implemented in CMOS includes a power PMOS pass transistor which substitutes for pass element 18 and a voltage divider substituting for feedback element 24. An input voltage $V_{in}$ is applied to the conduction terminal of the PMOS transistor. A parasitic resistance may be serially connected to output capacitance 28.

This circuit has a dominant pole determined by the output capacitance and dependent upon the load current. Thus, this pole is movable according to load variations and reaches a maximum value when the regulator supplies a maximum output current. This dependence upon the load current of the output pole renders the compensation of this type of voltage regulator complex.

Moreover, instability arises from a second internal pole that is generated by error amplifier 14, if proper compensation is not supplied. The present challenge of power management control systems is that linear voltage regulators often must compromise between robust stability and quiescent power consumption, wherein robust stability is dependent upon the frequency compensation technique.

One such frequency compensation technique is to provide a circuit component, such as the parasitic resistance, to introduce a zero, thereby compensating the effects of the output pole. As such, the output capacitance must be chosen to ensure that the parasitic resistance is kept within a predetermined range of values to provide stability for the voltage regulator. Unfortunately, the parasitic component of the output capacitor and its value may not be determined with high precision.

For this reason, as shown in FIG. 2, an LDO voltage regulator as disclosed in U.S. Pat. No. 6,300,749, which is incorporated by reference, includes Zero Mobile Compensation (ZMC) 54 which provides within the circuit response a zero capable of moving according to the load variations. Variable compensation is implemented within this design without using a compensation resistance to stabilized the amplifier loop of the voltage regulator 50. More specifically, the LDO voltage regulator 50 disclosed includes a zero that is moved toward higher frequencies according to the movement of its output pole.

This approach distinguishes from the previous approach in that a delay phase network 54, introducing a zero and a pole at the lower frequency, is included. The delay phase network 54 in its simplest form may be implemented using an RC network circuit portion. The resistance may be formed by a MOS transistor (not shown). The compensation zero and pole are obtained by the RC network 54, wherein the compensation zero is used to compensate the effect of the second pole in the loop gain. Thereby the circuit is compensated by a zero that moves to higher frequencies proportional to the load current.

Although this approach provides a compensation network with a moving zero, it is dependent upon sensing the load current. In addition, this approach uses a PMOS transistor for a pass element. There, however, exists a need for an NMOS linear voltage regulator that provides a moving zero.

U.S. Pat. No. 6,333,623 discloses an LDO linear NMOS voltage regulator which is incorporated herein. This voltage regulator includes an output stage having a NMOS pass transistor and an over-voltage pass device, such as PMOS discharge transistor or a discharge device which are arranged in complementary voltage follower configurations to both source load current to and sink load current from a regulated output voltage conductor. The NMOS pass transistor and the discharge device are controlled through a single feedback loop.

Although this approach provides a compensation network which limits the movement of the output pole by sinking current at the output of the voltage regulator. This approach focuses on the voltage transient problem. It, however, is unstable or inefficient, depending upon whether the sink current is relatively large or small in comparison to the load current, when an output capacitor $C_o$ is large and the load current is small. Therefore, this approach is only valuable within a limited range of the output capacitance wherein the output capacitance is small.

Thus, there exists a need for a LDO linear voltage regulator that overcomes the above described dynamic quiescent current limitation creating an internal zero moving in the same direction and having the same amplitude as the output pole, without sensing a portion of the load current over a large range of capacitance at the output. This voltage regulator must implement the use of a NMOS output power device, wherein the shift of the internal zero is the same amplitude and direction of the shift of the output pole to generate a better frequency compensation. In addition, this voltage regulator must not include current sensing but differential voltage sensing, such that no dynamic quiescent current exists.

SUMMARY OF THE INVENTION

The present invention overcomes the above-discussed deficiencies, including, the dynamic quiescent current limitation by creating an internal zero that moves in the same direction and has the same amplitude as that of the output pole without sensing a portion of the load current. The low drop out linear voltage regulator having frequency compensation in accordance with the present invention includes an error amplifier, a NMOS pass transistor, a variable compensation network, and a stabilization circuit. The error amplifier includes a power supply input connected to a first power supply, a non-inverting input coupled to a reference voltage, an inverting input and an output terminal. The NMOS pass transistor includes a source connected to an output terminal of the voltage regulator, a drain coupled to a second power supply, and a gate coupled to the output terminal of the error amplifier. The variable compensation network connects to the error amplifier. More particularly, the variable compensation network may include an RC circuit comprising a resistive transistor and a capacitance coupled in series. The stabilization circuit couples between the NMOS pass transistor and the resistive transistor such that the ratio of the impedance of the NMOS pass transistor to the impedance of the resistive transistor is constant.

Advantages of this design include but are not limited to low drop out linear voltage regulator that provides robust stability with low and invariable quiescent current. This voltage regulator implements the use of a NMOS output power device, wherein the shift of the internal zero is the same amplitude of the shift of the output pole to generate a better frequency compensation. In addition, this voltage regulator includes differential voltage sensing, such that no dynamic quiescent current exists.

BRIEF DESCRIPTION OF THE DRAWINGS

For a more complete understanding of the present invention and the advantages thereof, reference is now made to the following description taken in conjunction with the accompanying drawing in which like reference numbers indicate like features and wherein.

DETAILED DESCRIPTION OF PREFERRED EMBODIMENTS

Figure 1:
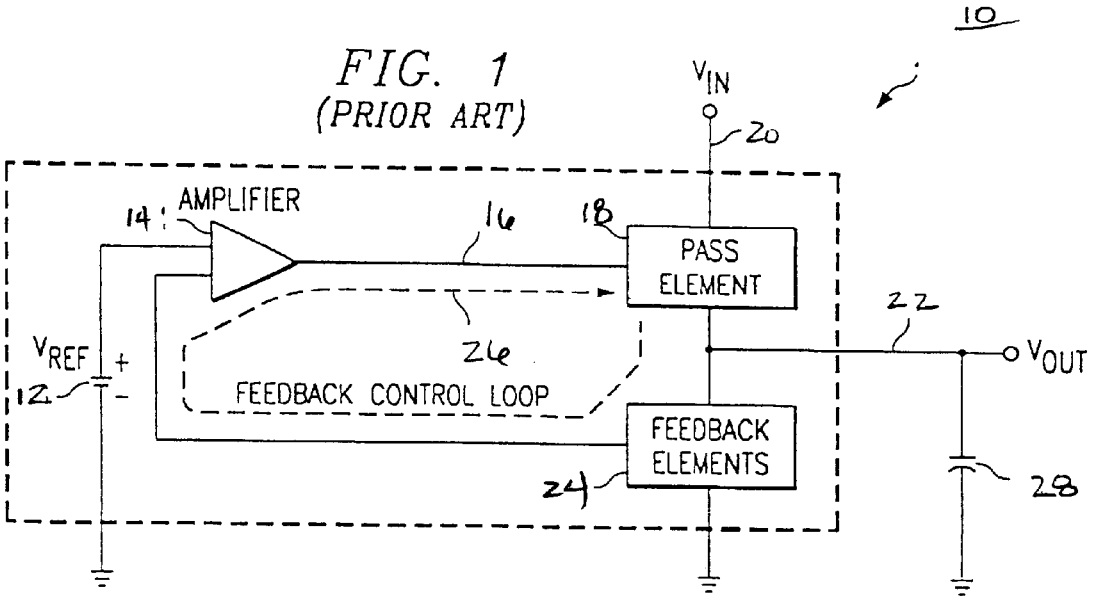
FIG. 1 (PRIOR ART)
FIG. 1 illustrates a known LDO linear voltage regulator.
Figure 2:
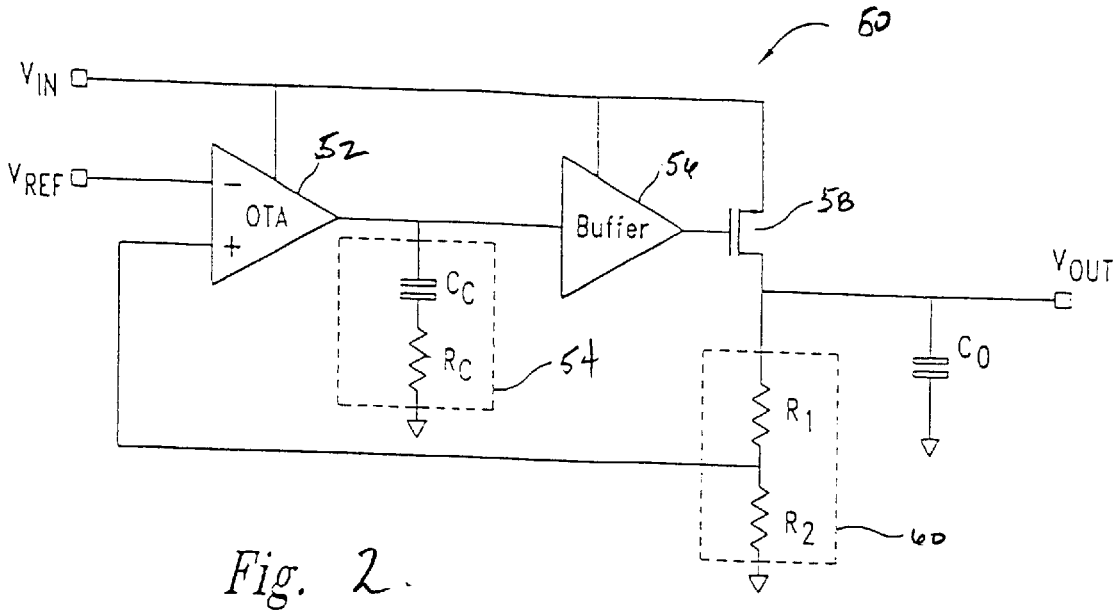
Fig. 2. (PRIOR ART)
FIG. 2 displays a schematic diagram for a known LDO linear voltage regulator.
Figure 3:
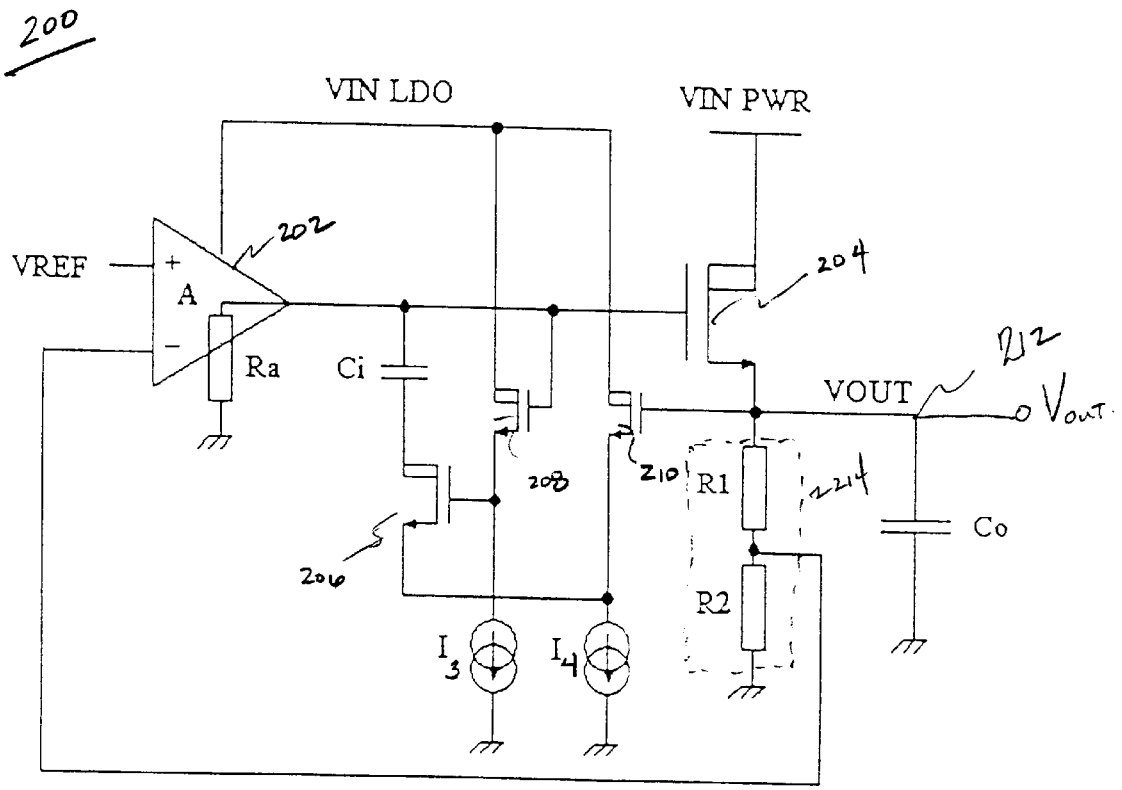
FIG. 3 illustrates a LDO linear NMOS voltage regulator in accordance with the present invention.

FIG. 3 illustrates the LDO NMOS linear voltage regulator 200 in accordance with the present invention. This voltage regulator 200 includes a NMOS pass transistor 204 having a drain coupled to an unregulated input voltage conductor $V_{IN\text{-}PWR}$, a source coupled to a regulated output voltage conductor 212, and a gate coupled to an output of an error amplifier 202. The error amplifier 202 includes a non-inverting input coupled to a voltage reference $V_{REF}$ which is also coupled to ground. The inverting input of the error amplifier 202 is coupled to feedback network 214 which is coupled between the regulated voltage conductor 212 and ground and comprises two resistors, $R_1$ and $R_2$, coupled in series. As shown regarding, amplifier 202, the output impedance is represented by impedance $R_a$.

A delay phase network is formed by an RC network portion including internal capacitor $C_i$ and resistive transistor 206 coupled in series generates a compensation zero and pole, wherein the compensation zero is used to compensate the effect of the second pole in the loop gain. The stabilization circuit includes transistors 208 and 210 that are matched devices having the same device characteristics (i.e. carrier mobility, size, etc.) that sink identical currents from bias current sources, $I_3$ and $I_4$, to supply the current necessary to equalize the voltage followers formed by transistors 208 and 210. Thus, the effective gate to source voltage of transistor 206 is forced to equal the effective gate to source voltage of transistor 204, wherein the effective gate to source voltage equals the gate to source voltage minus the threshold voltage $V_t$ of the corresponding transistor. Transistor 206 includes a gate connected to the source of transistor 208, a drain coupled to capacitor Ci and a source connected to current source $I_4$. Transistor 208 includes a drain connected to voltage supply $V_{IN\text{-}LDO}$, a gate connected to the gate of pass transitory 204 and a source connected to current source $I_3$. Transistor 210 includes a drain connected to voltage supply $V_{IN\text{-}LDO}$, a gate connected to the output node 212, and a source connected to current source $I_4$.

The input voltage of the regulator 200 is split into two voltage supplies: $V_{IN\text{-}LDO}$ and $V_{IN\text{-}PWR}$. The objective of the split in voltage supply is to avoid use of a charge-pump circuit widely implemented in NMOS linear voltage regulators which would connect between both voltage supplies. In low-voltage digital circuits for portable applications, this design avoids the use of a charge pump through the use of drain extended transistors, 204–210. Moreover, by connecting voltage supply $V_{IN\text{-}LDO}$ to a high voltage battery and voltage supply $V_{IN\text{-}PWR}$ to a lower voltage, improves the power efficiency of the voltage regulator 200.

Capacitor $C_o$ is the output bypass capacitor which can be internal or external to the chip. The parasitic resistance of capacitor $C_o$ is not used in the frequency compensation, and thus, is not shown in FIG. 3 due to its negligible effects upon the circuit.

There are several operating requirements that must exist to effectively stabilize the regulator 200. First, resistance $R_a$ must be substantially larger than resistance $R_{on\text{-}206}$ of transistor 206. Furthermore, the transconductance $Gm_{210}$ of transistor 210 must be substantially larger than the reciprocal of the resistance $R_{on\text{-}206}$ of transistor 206. The gate to source capacitance $Cgs_{204}$ of transistor 204 must be negligible compared to external capacitor $C_o$ and internal capacitor $C_i$. Lastly, resistors, $R_1$ and $R_2$, must be substantially larger than $1/gm_{204}$ or $1/gds_{204}$ In operation, the output pole of voltage regulator 200 is:

$$P_o=1/(Co/\mu C_{ox}(W/L)_{204}(Vgs_{204}-Vt);$$

while the internal zero of voltage regulator 200 is:

$$Z_i=1/(Ci/\mu C_{ox}(W/L)_{206}(Vgs_{206}-Vt).$$

Since transistors, 204 and 206, are the same type of transistors and, thereby, have same carrier mobility $\mu$, and oxide capacitance $C_{ox}$, the internal zero $Z_i$ will cancel the output pole $P_o$ such that the output pole $P_o$ and internal zero $Z_i$ are moving in the same direction. Proper selection of capacitors $C_o$ and $C_i$, is required such that the equation, $C_o/(W/L)_{204}=C_i/(W/L)_{206}$, will hold true and, thereby, make the amplitude of the output pole $P_o$ and internal zero $Z_i$ the same.

In contrast, the input pole of the voltage regulator is:

$$P_i=1/(C_iR_a)$$

which is independent of the load current and, thus, has negligible affects with regard to frequency compensation.

In operation, when transistor 204 is in the saturation or linear region, the pole/zero description is validated. When the load current is very low, transistor 204 goes into the sub-threshold region which invalidates the pole/zero analytic description wherein the external pole $P_o$ no longer equals the internal zero $Z_i$. The internal zero $Z_i$, however, is still present to prevent instability. When transistor 204 is saturated, the phase margin with respect to the load current is high and flat and has a low decrease at low load current. These characteristics in the phase margin guarantees the system's stability.

According to the previous description, this novel linear voltage regulator 200 architecture has advantage of combining a very low invariable quiescent current with a very robust frequency compensation. Its simple implementation guarantees real estate savings regarding chip implementation of the design.

The reader's attention is directed to all papers and documents which are filed concurrently with this specification and which are open to public inspection with this specification, and the contents of all such papers and documents are incorporated herein by reference.

All the features disclosed in this specification (including any accompany claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A low drop out linear voltage regulator having frequency compensation, a first and a second power supply, comprising:

an error amplifier having a control input coupled to the first power supply, a non-inverting input coupled to a reference voltage, an inverting input and an output terminal;

an NMOS pass transistor having a source connected to an output terminal of the voltage regulator, a drain coupled to the second power supply, and a gate coupled to the output terminal of the error amplifier;

a variable compensation network connected to the output terminal of the error amplifier, wherein the variable compensation network includes an RC circuit comprising a resistive transistor and a capacitance coupled in series; and a stabilization circuit coupled between the NMOS pass transistor and the resistive transistor, to equalize the gate to source voltage of the NMOS pass transistor and the gate to source voltage of the resistive transistor, wherein the stabilization circuit comprises, a first bias current source coupled between the gate of the resistive transistor and ground, a second bias current source coupled between the source of the resistive transistor and ground, a first bias transistor having a source coupled to the gate of the resistive transistor, a drain coupled to the first power supply, a gate coupled to the gate of the NMOS pass transistor, and a second bias transistor having a source coupled to the second bias current source, a gate coupled to the output terminal of the voltage regulator, a drain coupled to the first power supply.

2. A voltage regulator as recited in claim 1, further comprising a voltage divider connected between the output terminal of the voltage regulator and the inverting input of the error amplifier, the voltage divider coupled in a feedback loop to the inverting input of the error amplifier.

3. A voltage regulator as recited in claim 1, wherein the NMOS pass transistor is a NMOS power transistor having an extended drain.

4. A voltage regulator as recited in claim 1, wherein the resistive transistor is a NMOS power transistor having an extended drain.

5. A voltage regulator as recited in claim 1, wherein the second bias transistor is a NMOS power transistor having an extended drain.

6. A voltage regulator as recited in claim 1, wherein the first bias transistor is a NMOS power transistor having an extended drain.

* * * * *